United States Patent [19]

Stroh

[11] Patent Number: 4,475,432

[45] Date of Patent: Oct. 9, 1984

[54] STRING-CLAMPING MEANS

[76] Inventor: Paul F. Stroh, 1022 - 42nd SW., Seattle, Wash. 98146

[21] Appl. No.: 315,318

[22] Filed: Oct. 26, 1981

[51] Int. Cl.[3] ..... G10D 3/12

[52] U.S. Cl. ..... 84/314 N; 84/214; 84/313

[58] Field of Search ..... 84/186 WP, 202, 214, 84/297 R, 298, 299, 307, 313, 314 R, 314 N, 312 R

[56] References Cited

U.S. PATENT DOCUMENTS

| | | | |
|---|---|---|---|
| 144,842 | 11/1873 | Ellis | 84/214 |
| 907,713 | 12/1908 | Avisus | 84/214 |
| 3,693,490 | 9/1972 | Raphael | 84/186 WP |
| 3,695,137 | 10/1972 | Eurich | 84/312 R |
| 4,135,426 | 1/1979 | Rickard | 84/298 X |
| 4,171,661 | 10/1979 | Rose | 84/313 |
| 4,248,127 | 2/1981 | Lieber | 84/314 N |

*Primary Examiner*—Lawrence R. Franklin
*Attorney, Agent, or Firm*—Ward Brown; Robert W. Beach

[57] ABSTRACT

The nut of a guitar includes several separate string-clamping blocks forming a row extending laterally of the guitar strings with each string being fitted between adjacent blocks. A bolt extending through the blocks has an enlarged head engaging the block at one end of the row and is threaded into the block at the other end of the row. Turning of the bolt in one sense tends to move the end blocks toward each other, thereby clamping the strings between the blocks and preventing movement of the strings across the nut as the guitar is played. The bridge of the guitar includes a movable bridge mounting plate which can be manipulated so as to produce a tremulous tone effect. The low friction pivot mounting for the bridge mounting plate consists of a sharpened end of the plate received in a transverse groove of a mounting flange. Alternatively the bridge mounting plate can be locked in fixed position relative to the remainder of the guitar body. The guitar strings are anchored closely adjacent to the bridge mounting plate and closely adjacent to the points where they cross the bridge to reduce the possibility that they will slide across the bridge as the guitar is played.

7 Claims, 10 Drawing Figures

STRING-CLAMPING MEANS

BACKGROUND OF THE INVENTION

1. Field of the Invention

The present invention relates to stringed musical instruments, particularly guitars, and, more particularly, guitars having tremolo devices, that is, devices for rapidly changing the string tension so as to produce a tremulous tone effect.

2. Prior Art

At the soundboard or body end portion of a guitar, the guitar strings are anchored to a bridge which, in some guitars, can be manually reciprocated or oscillated relative to the guitar body so as to change the string tension and produce a tremulous tone effect. Between the head and neck positions of the guitar, the strings pass over the nut which usually is grooved to receive the strings. Manipulation of the tremolo device can cause a string to slide over the nut. Friction can prevent the string from returning to precisely the same position as prior to manipulation of the tremolo device, with the result being that the guitar no longer is in tune.

Rose U.S. Pat. No. 4,171,661 discloses "string restraining means" for clamping opposite end portions of the guitar strings against the nut and the bridge, respectively, so as to prevent this type of sliding movement. In the Rose mechanism, a rigid bar extending over two adjacent strings is secured into the nut so as to clamp the two strings between the bar and the nut. At the bridge end a separate block is provided for each string to clamp it between the block and the bridge.

For a conventional guitar having six strings, three separate bars of the Rose design must be loosened so that the guitar can be tuned by use of the conventional screw or worm tension-adjusting mechanism to which the strings are anchored at the head of the guitar. To replace a string, the clamping block at the bridge end also must be loosened or removed.

An additional problem with known guitars fitted with tremolo devices is that altering the tension of an individual string may result in changing the tensions of all of the other strings. A skilled musician can force a string transversely of the neck of the guitar so as to alter the string tension, but for a guitar fitted with a conventional tremolo device, altering the tension of one string in this manner may cause movement of the movable bridge which changes the tensions of all of the other strings.

A further problem with known guitars fitted with tremolo devices is that there is high friction between the movable bridge and the guitar body so that the bridge may not always return to precisely the same position. In the Rose device, for example, concave cutouts are provided in the forward end of the opposite lateral sides of a movable bridge plate, which cutouts are fitted beneath the heads of screws projecting up from the guitar body. As best seen in FIG. 4 of the Rose patent, the forward end of the bridge plate is pinched between the tapered screw heads and nuts or "flanged shoulders" immediately beneath the screw heads.

SUMMARY OF THE INVENTION

It is an object of the present invention to provide an improved tremolo device for a musical instrument of the type having several generally parallel strings which device is usable for changing the string tension so as to produce a desired tremulous tone effect without causing the instrument to go out of tune.

In accordance with the principal object, it is an object to provide string-clamping mechanism at the nut of a guitar which mechanism is of uncomplicated, inexpensive construction and simple yet reliable in use.

An additional object is to provide such a tremolo device which is usable for producing a tremulous tone effect with respect to all of the strings but which, optionally, may be rendered inoperative such that a skilled musician can alter or "bend" the pitch of an individual string without affecting the other strings.

A further object is to provide such a tremolo device in which the tendency of strings to slide across the bridge during use of the tremolo device is lessened, without requiring clamping the strings to the bridge.

These and other objects are accomplished by the tremolo accessory described in detail below with reference to the accompanying drawings.

DETAILED DESCRIPTION

Figure 1:
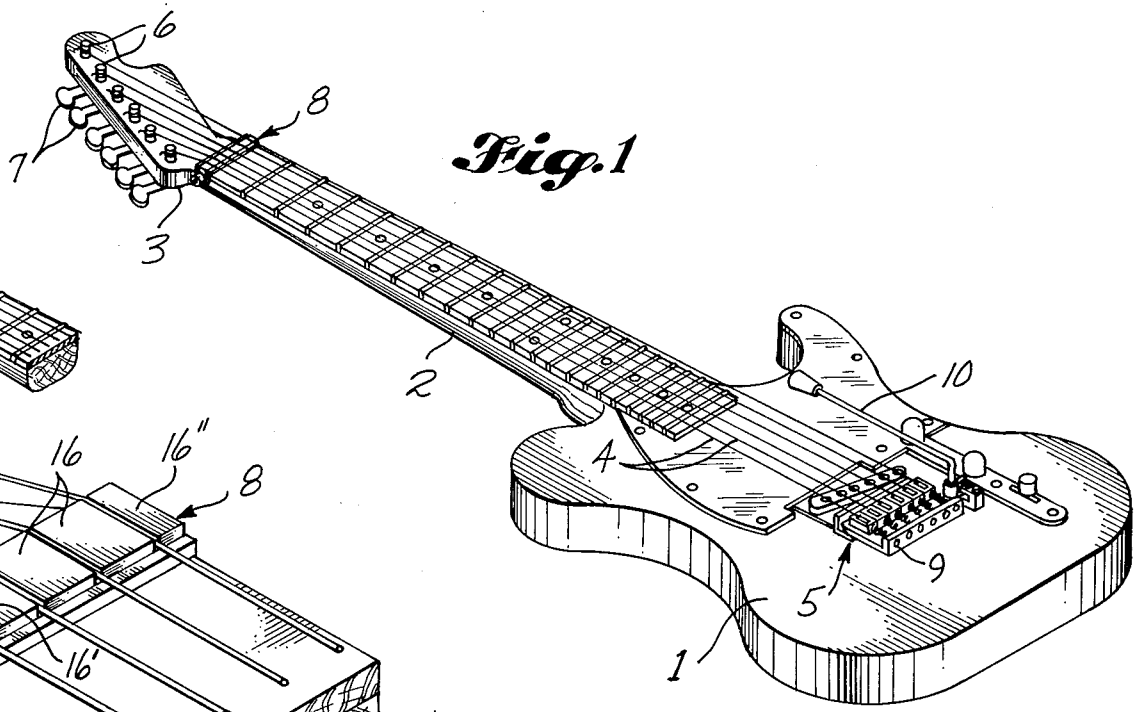
FIG. 1 is a top perspective of a guitar having a tremolo accessory in accordance with the present invention.

The guitar shown in FIG. 1 is of conventional construction with the exception of the tremolo accessories in accordance with the present invention described further below. In general, the guitar includes a soundboard or body portion 1 from which the neck 2 projects and ends at the head portion 3. Several parallel strings 4 have their opposite ends anchored, respectively, to the bridge portion 5 carried by the body and the conventional tension or tuning adjustment mechanism in the form of upright pins 6 rotatable by turning the adjustment screws 7. Between the neck and head portions of the guitar the strings pass over the nut 8. As is conventional with guitars fitted with tremolo devices, the bridge portion of the guitar includes a bridge mounting plate 9 which is movable by manipulation of a control handle 10 so as to affect rapid but slight alterations in the string tension and thereby produce a tremulous tone effect.

Figure 2:
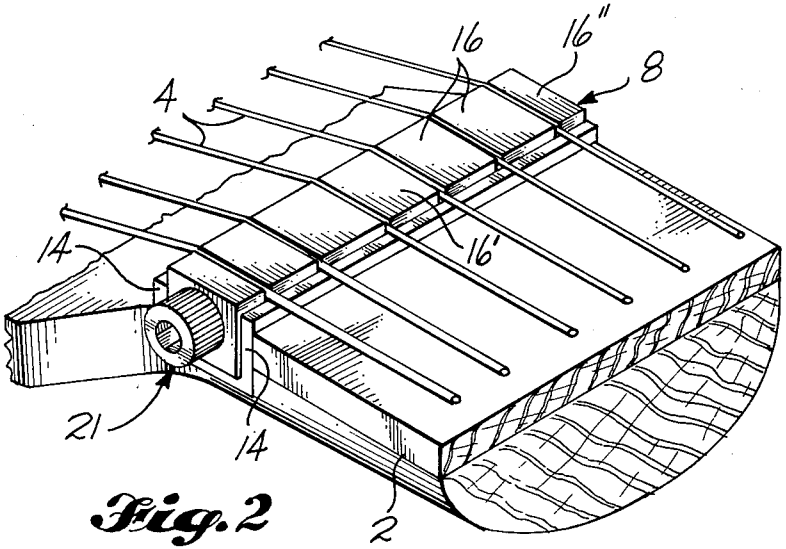
FIG. 2 is an enlarged fragmentary top perspective of the nut portion of the guitar of FIG. 1 showing in greater detail improved string-clamping mechanism in accordance with the present invention.
Figure 3:
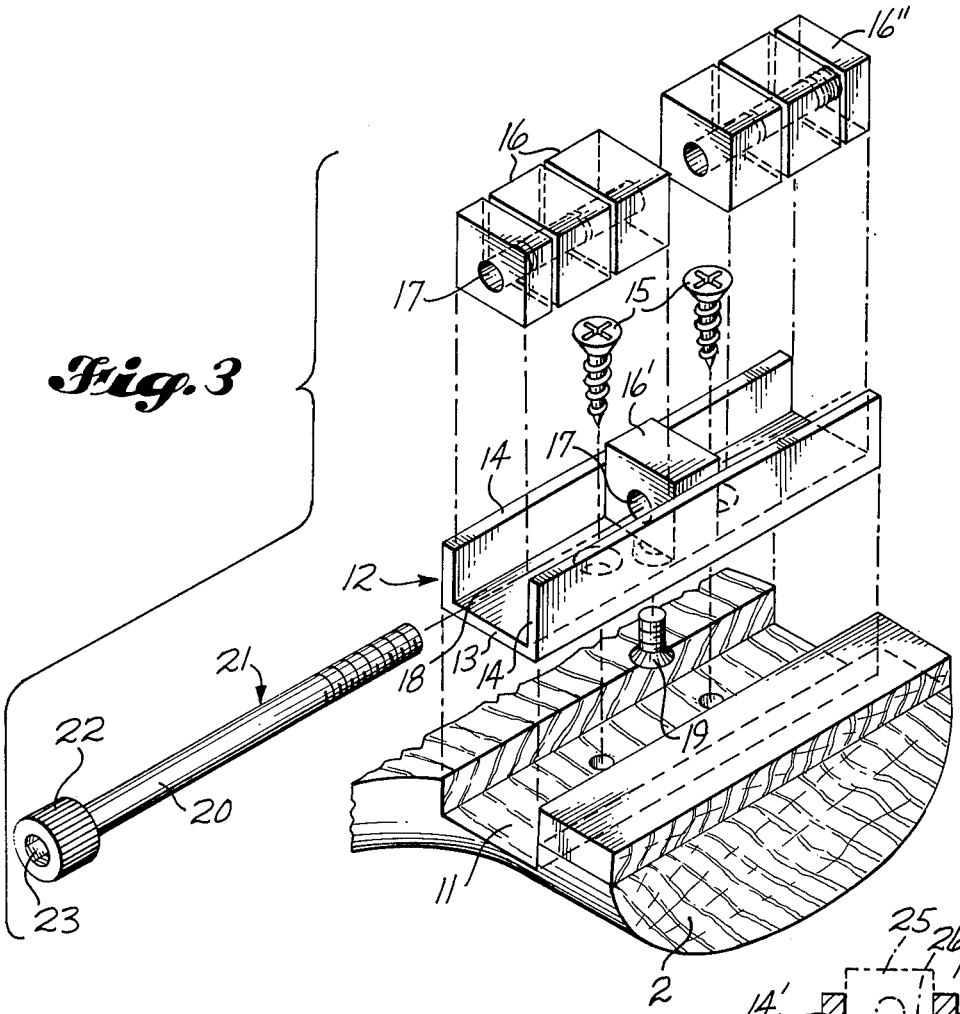
FIG. 3 is a corresponding, somewhat exploded, fragmentary top perspective.

As best seen in FIGS. 2 and 3, the nut portion of the guitar includes string-clamping mechanism in accordance with the present invention so as to prevent sliding movement of the strings over the nut by operation of the tremolo device. As best seen in FIG. 3, a groove 11 is cut transversely across the upper face of the guitar at the upper end of the neck 2 f or receiving the rigid, generally U-shaped channel plate 12. The bottom web 13 of the channel plate is screwed into the bottom of the groove 11 with the upward projecting side flanges 14 of the channel plate in substantially contiguous engagement with the upright sides of the groove. The heads of the wood screws 15 securing the channel plate 12 in the groove 11 are countersunk in the upper surface of the web of the channel plate.

A row of separate, generally rectangular string-clamping blocks 16 having registered apertures 17 are arranged in side-by-side relationship in the upward opening groove 18 formed by the channel plate. The shape of each block is substantially complementary to the shape of the channel groove. Preferably, at least one of the blocks, such as the center block 16', is rigidly secured to the channel plate by a short machine screw 19 screwed into such center block from below and having its head countersunk in the underside of the web 13 of the channel plate. The upper end of such machine screw stops short of the aperture 17 of the block 16'.

The cross-sectional size of the registered apertures 17 through the string-clamping blocks 16 is sufficient that the shank 20 of a bolt 21 may be slid through them, with the exception of an end block 16" which is in the form of a nut having a slightly smaller central aperture with threads complementary to the threads of the bolt. The other end of the bolt has an enlarged knurled head 22 engageable against the other end block and adapting the bolt to be turned manually. Such enlarged head has an axial socket 23 of hexagonal cross section allowing additional tightening of the bolt.

As best seen in FIG. 2, the axial length of each string-clamping block, other than the end blocks, corresponds to the desired distance between adjacent strings. The height of the blocks is uniform such that the blocks project upward above the upper sides of the flanges 14 of the channel plate 12. Each guitar string 4 is fitted between adjacent blocks, whereupon the bolt 21 is tightened to clamp the strings in vice-like fashion, thereby preventing movement of the strings across the nut. Loosening of the single bolt such as by an Allen wrench which, when not in use, can be held in a bracket beneath the head of the guitar, allows tuning the guitar by turning the tension adjustment screws.

Figure 4:
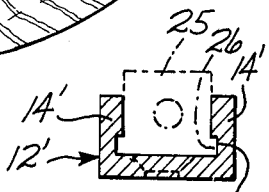
FIG. 4 is a somewhat diagrammatic transverse cross section of alternative string-clamping mechanism in accordance with the present invention.

In the alternative embodiment shown in FIG. 4, the modified channel plate 12' has side flanges 14' with undercut grooves 24 at their bases; and, as illustrated in broken lines, the string-clamping blocks 25 fitted in such plate can have corresponding projections 26 received in the slots 24 for a more positive sliding mounting of the blocks in the channel plate. In the embodiment of FIGS. 2 and 3, up and down movement of the blocks relative to the channel plate is prevented by the bolt 21 extending through the block 16' rigidly secured to the channel plate; whereas in the embodiment of FIG. 4 up and down sliding movement of the blocks 25 is prevented by the projections 26 of the blocks being received in the slots 24 of the upright flanges 14' of the channel plate 12'. Nevertheless, even in the embodiment of FIG. 4 it is preferred that at least one of the blocks 25 be rigidly secured to the channel plate 12' so as to prevent sliding of the row of blocks lengthwise of the channel plate.

Figure 5:
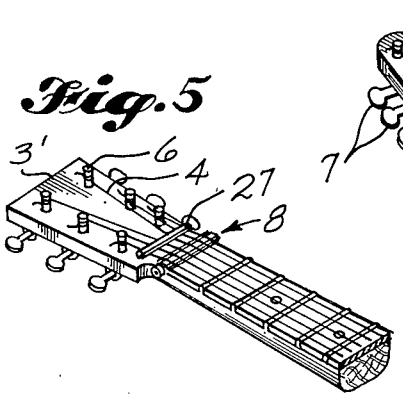
FIG. 5, on the drawing sheet with FIGS. 1 and 2, is a fragmentary top perspective of the upper neck and head portions of another guitar having string-clamping mechanism in accordance with the present invention, illustrating an optional feature of such mechanism.

In the form of guitar shown in FIG. 1, each of the rotatable anchoring pins 6 at the head of the guitar is substantially aligned with the portion of its string extending lengthwise of the neck. For a guitar in which the pins are not aligned with their strings, such as the guitar shown in FIG. 5, it is preferred that the strings 4 be aligned prior to crossing the nut 8. The alignment bar 27 shown in FIG. 5 is mounted between the anchoring pins 6 and the nut and has a transversely extending groove in its underside for each string. The underside of the alignment bar is spaced above the upper surface of the head 3' of the guitar. In the preferred embodiment, mounting screws extend downward through the alignment bar and through spacers fitted between the underside of the bar and the upper surface of the head of the guitar.

While the head end portions of the strings flare outward from the alignment bar to their rotatable anchoring pins, between the bar and the nut the strings are aligned with the spaces between the string-clamping blocks of the nut. It also is preferred that the height of the grooves in the alignment bar be at least as great as the diameter of the largest string so that the strings are securely received in their grooves, and that the alignment bar hold the strings no higher than the top of the nut so that the strings are positively held downward between the string-clamping blocks.

Figure 6:
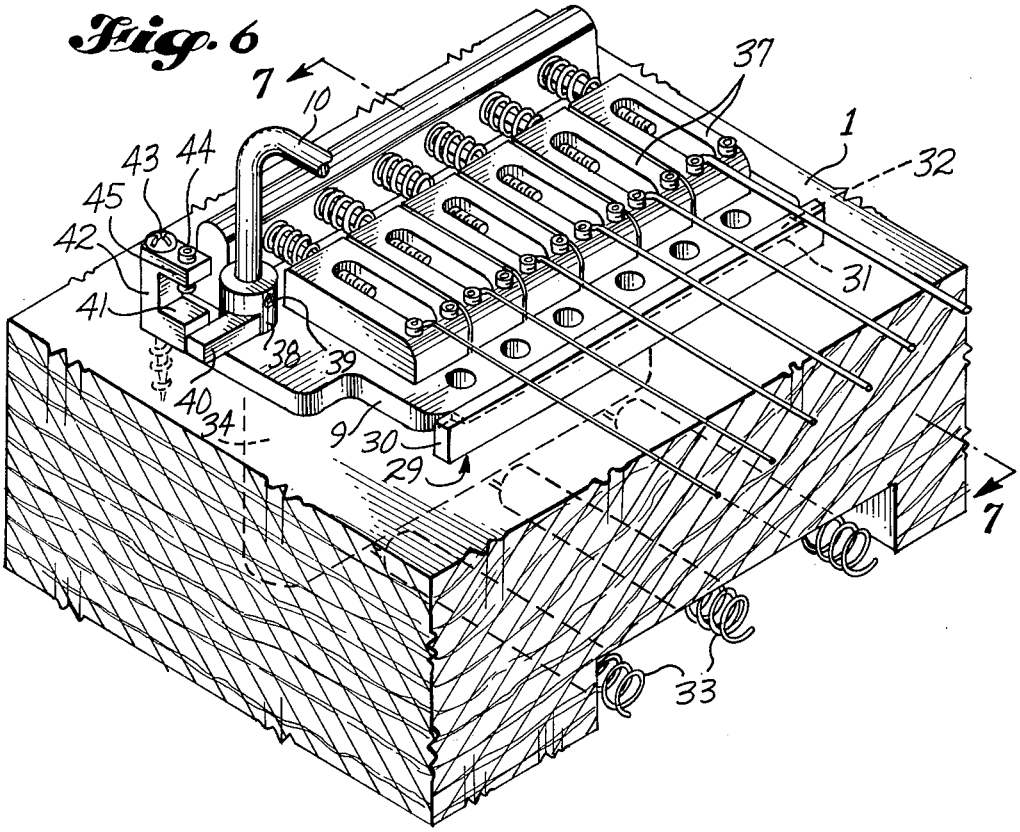
FIG. 6 is an enlarged fragmentary top perspective of the bridge portion of the guitar of FIG. 1.
Figure 7:
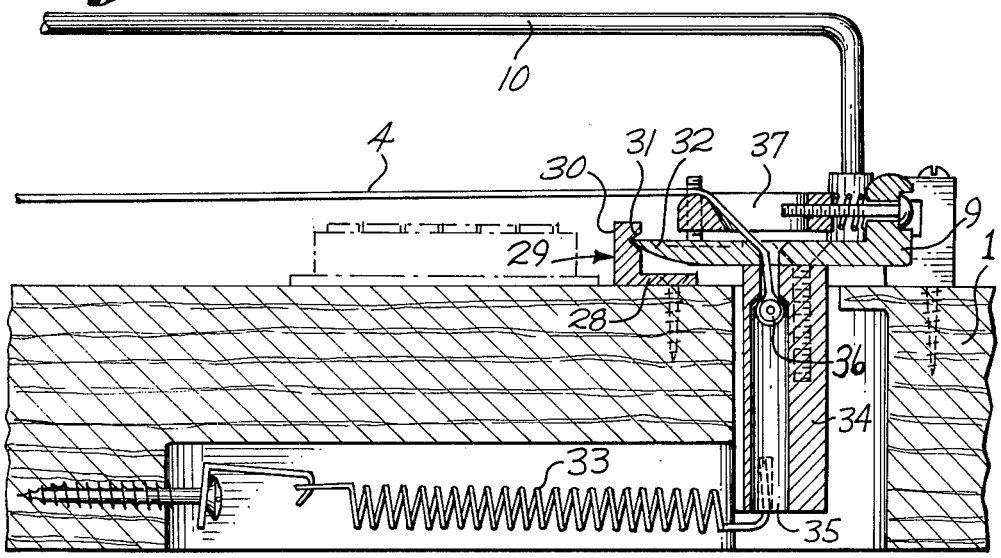
FIG. 7 is a section taken generally along line 7—7 of FIG. 6.
Figure 8:
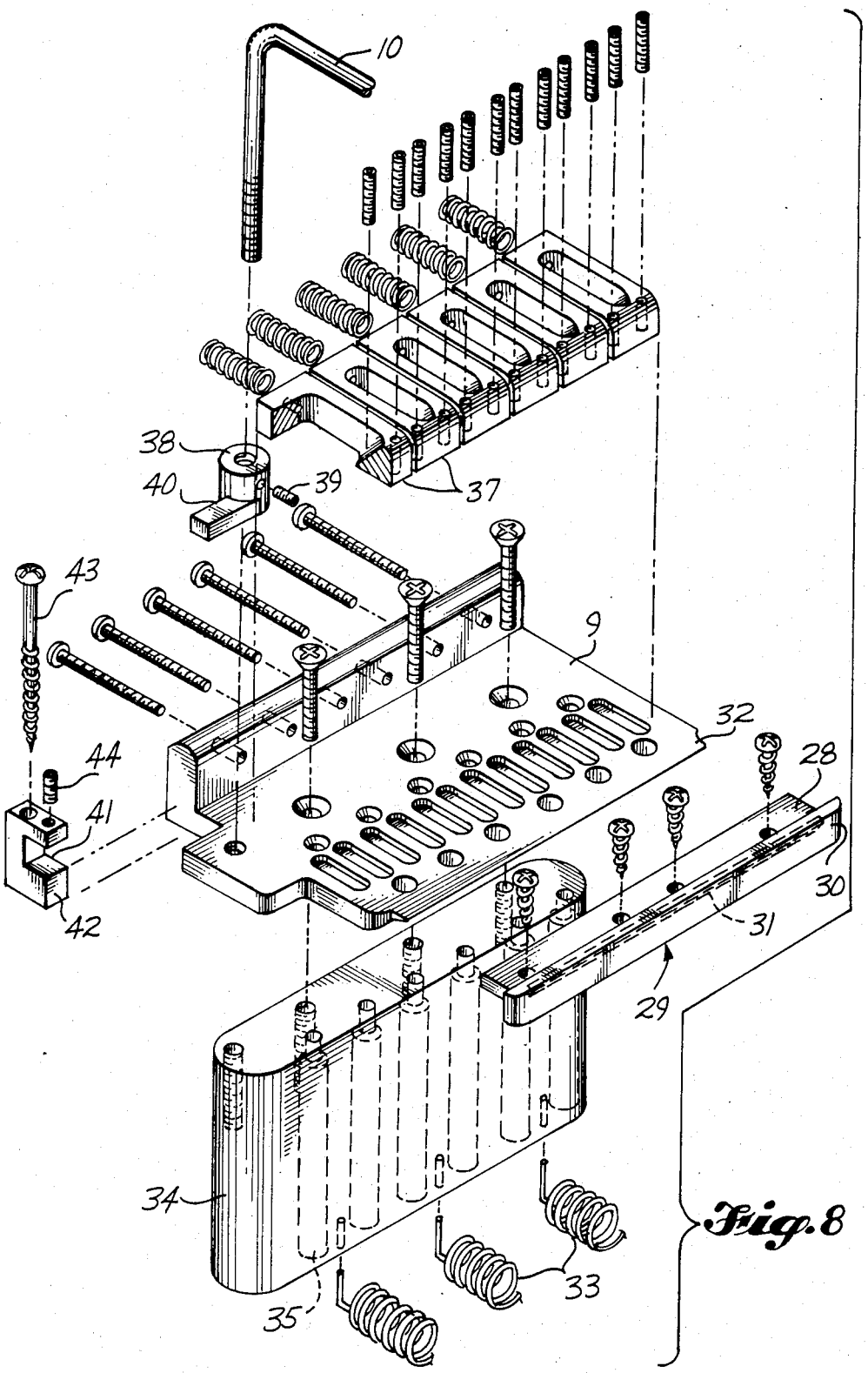
FIG. 8 is an exploded top perspective of such bridge portion.

As shown in FIGS. 6, 7 and 8, a further improvement of the present invention is the mounting of the movable bridge mounting plate 9 to the body portion 1 of the guitar. As best seen in FIG. 7, one flange 28 of an angle plate 29 is screwed to the body of the guitar with its other flange 30 projecting upward. Such upward projecting flange has an angle groove 31 extending transversely of the guitar but ending short of the opposite ends of the angle plate 29. The leading end 32 of the bridge mounting plate 9 decreases in thickness toward its sharp tip fitted in the groove.

The tension of the guitar strings 4 tends to pull the bridge plate upward but this force is offset by the tension of the return springs 33 connected between the underside of the guitar body and an upright mounting block 34 rigidly connected to the underside of the bridge mounting plate. Sliding of the bridge mounting plate transversely of the length of the guitar is not permitted because the groove 31 does not extend to the opposite ends of the angle plate 29. The angle defined by the inner faces of the groove is greater than the angle defined by the outer faces of the tapered leading end portion 32 of the bridge mounting plate so that the only point of contact of the bridge mounting plate with the body portion of the guitar is by its sharpened leading end in the base of the groove. This low friction mounting assures return of the bridge mounting plate to precisely the same position after each manipulation of the tremolo device.

Conventionally an upright mounting block for a movable bridge, corresponding to the upright block 34, has upright bores for receiving the individual guitar strings with the strings being anchored at the base of the block. In accordance with the present invention, the upright mounting block 34 has bores 35 of a diameter so as to permit each string to be anchored toward the upper end of the block, such as by a mounting peg 36 best seen in FIG. 7. This reduces the length of string from its anchoring point to the point where it crosses the bridge, such as at the leading end of its individual slotted adjustment block 37, which decreases the possibility that any substantial length of string will slide over the bridge during manipulation of the tremolo device, without requiring clamping the string to the bridge.

Figure 9:
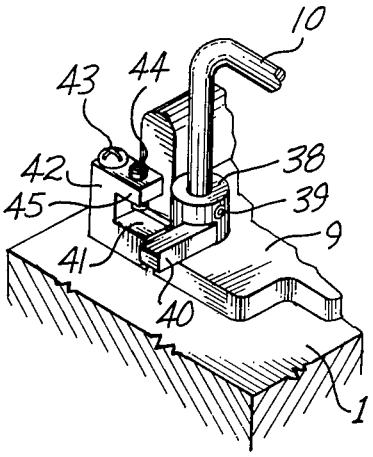
FIGS. 9 and 10, on the drawing sheet with FIGS. 3 and 4, are corresponding enlarged fragmentary top perspectives of a rear corner of the bridge portion of the guitar of FIG. 1, with parts in different positions.
Figure 10:
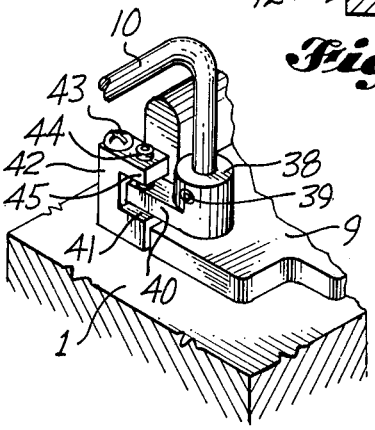

A further improvement of the present invention is the provision of mechanism for locking the bridge mounting plate in fixed position relative to the body of the guitar, best seen in FIGS. 6, 9 and 10. As is conventional, the perpendicularly bent control handle 10 of the tremolo device may be turned through an angle of at least 90° between an operating position in which its upper end portion extends forward generally lengthwise of the guitar to a position extending transversely of the guitar and away from the bridge. In accordance with the present invention, a collar 38 is fixed to the lower end portion of the control handle by a set screw 39 and has a generally radially projecting latch arm 40.

In the operating position of the control arm extending lengthwise of the guitar, shown in FIG. 9, the latch arm 40 extends transversely of the guitar and away from the bridge. When the control arm is swung to inoperative position extending transversely of the guitar, shown in FIG. 10, the arm 40 is swung rearward into the mouth 41 of a lock or catch block 42 fixed to the guitar body by a wood screw 43. Preferably, such catch block is mounted to the rear of the bridge plate and has its mouth or slot 41 opening forward. An upright adjustment screw 44 extends through the upper jaw of the catch block into close proximity to the upper side of latch arm 40 so as to prevent appreciable movement of the latch arm, the control arm and the bridge mounting plate when the control handle is swung to the inoperative position. Consequently, the tension and pitch of an individual string can be altered manually without causing swinging movement of the bridge mounting plate which would alter the tensions of all of the other strings. With the control arm swung forward, the latch arm is freed from the catch block and the control arm can be manipulated to produce a desired tremulous tone effect.

I claim:

1. In a guitar-like musical instrument, a head end portion and a body end portion, several elongated, generally parallel, transversely spaced strings, means for anchoring the opposite end portions of said strings at said head and body end portions, respectively, a neck portion having an upper surface forming a fingerboard, a nut portion between said head and neck portions for maintaining said strings a desired distance above the fingerboard, means for clamping said strings closely adjacent to said nut portion and including several upright, separate, string-clamping block portions forming a row extending transversely of said strings, each of a plurality of individual strings being fitted between adjacent block portions, and means guiding said block portions for movement toward each other so as to clamp firmly the strings fitted therebetween and away from each other so as to release said strings in the area of said nut portion while said strings remain anchored at said head and body portions, said clamping means including block-moving means engageable against said block portions at opposite ends of said row, respectively, for effecting such relative movement of said block portions toward each other and releasable for permitting relative movement of said block portions away from each other, said block-moving means being disposed entirely below said strings in the area of said nut portion so that, with said block-moving means released, said strings can be moved upward from between said block portions without interference from said block-moving means.

2. In a guitar-like musical instrument, a head end portion and a body end portion, several elongated, generally parallel, transversely spaced strings, means for anchoring the opposite end portions of said strings at said head and body end portions, respectively, a neck portion having an upper surface forming a fingerboard, a nut portion between said head and neck portions for maintaining said strings a desired distance above the fingerboard, several separate string-clamping blocks forming a row extending transversely of said strings closely adjacent to said nut portion, each of a plurality of individual strings being fitted between adjacent blocks, said blocks being relatively movable toward each other so as to clamp firmly the strings fitted therebetween, and one and only one bolt extending through said blocks and turnable for effecting such relative movement of said blocks to clamp said strings.

3. In the instrument defined in claim 2, one end portion of the bolt having an enlarged head engageable against the block at one end of the row, said head being adapted to be turned manually without the use of tools.

4. In the instrument defined in claim 2, a channel recessed into the upper surface of the instrument in the area of the nut portion and receiving the row of blocks.

5. In the instrument defined in claim 4, the shape of at least one of the blocks being substantially complementary to the shape of the channel.

6. In the instrument defined in claim 4, at least one lateral side of the channel being undercut and at least one of the blocks having a projecting portion received in said undercut side of the channel.

7. In the instrument defined in claim 4, at least one of the blocks being rigidly secured to the channel.

* * * * *